US009981821B2

(12) United States Patent
De Marco et al.

(10) Patent No.: US 9,981,821 B2
(45) Date of Patent: May 29, 2018

(54) SPLICING EQUIPMENT FOR STRIPS WOUND ON A PAIR OF SPOOLS

(71) Applicant: Tecnau S.R.L., Ivrea (IT)

(72) Inventors: Giuliano De Marco, Ivrea (IT); Armando Aprato, Ivrea (IT); Marco Andreuccetti, Ivrea (IT)

(73) Assignee: Tecnau S.R.L., Ivrea (IT)

( * ) Notice: Subject to any disclaimer, the term of this patent is extended or adjusted under 35 U.S.C. 154(b) by 73 days.

(21) Appl. No.: 15/047,896

(22) Filed: Feb. 19, 2016

(65) Prior Publication Data

US 2016/0244290 A1 Aug. 25, 2016

(30) Foreign Application Priority Data

Feb. 19, 2015 (IT) ..... TO2015A0115

(51) Int. Cl.

| | |
|---|---|
| ***B65H 19/18*** | (2006.01) |
| ***B65H 35/00*** | (2006.01) |
| ***B65H 19/10*** | (2006.01) |
| ***B65H 21/00*** | (2006.01) |

(52) U.S. Cl.

CPC ..... *B65H 35/0046* (2013.01); *B65H 19/102* (2013.01); *B65H 19/18* (2013.01); *B65H 19/1852* (2013.01); *B65H 21/00* (2013.01); *B65H 2301/4621* (2013.01); *B65H 2301/46312* (2013.01)

(58) Field of Classification Search

CPC .. B65H 19/18; B65H 19/102; B65H 19/1852; B65H 21/00; B65H 2301/4621; B65H 2301/46312

See application file for complete search history.

(56) References Cited

U.S. PATENT DOCUMENTS

| | | | | |
|---|---|---|---|---|
| 3,858,819 | A * | 1/1975 | Butler, Jr. ..... | B65H 19/1852 156/504 |
| 4,331,301 | A | 5/1982 | Martinez | |
| 5,064,488 | A | 11/1991 | Dickey | |
| 5,388,387 | A * | 2/1995 | McElvy ..... | B65B 9/207 156/502 |
| 8,002,924 | B2 * | 8/2011 | Machamer ..... | B65H 19/1836 156/157 |

FOREIGN PATENT DOCUMENTS

| | | |
|---|---|---|
| DE | 1256501 B | 12/1967 |
| GB | 2060570 A | 5/1981 |

* cited by examiner

*Primary Examiner* — Sang K Kim

(74) *Attorney, Agent, or Firm* — Banner & Witcoff, Ltd.

(57) ABSTRACT

Splicing equipment for strips of paper, paper tissue, plastic and the like, defines an outgoing strip with a first strip and a second strip directed toward a user apparatus by means of two cutting mechanisms and two splicing group. In particular, the equipment comprises an output arresting mechanism actuatable for arresting the outgoing strip during the operations of cutting and splicing; and two respective applying devices for a double sided adhesive film. The splicing groups include a respective retaining member provided for retaining, after cutting and separation, an initial edge of the first strip or, respectively, an initial edge of the second strip in preparation of splicing on a terminal edge of the outgoing strip; and in which the applying devices are selectively actuatable for automatically depositing the double sided adhesive film on the initial edge of the first strip or, respectively, on the initial edge of the second strip.

17 Claims, 14 Drawing Sheets

SPLICING EQUIPMENT FOR STRIPS WOUND ON A PAIR OF SPOOLS

RELATED APPLICATION

This application claims priority to Italian Application No. TO2015A000115 filed Feb. 19, 2015, and entitled "Splicing equipment for strips", the content of which is incorporated herein by reference in its entirety.

FIELD OF THE INVENTION

The present invention relates to splicing equipment for strips or webs wound on a pair of spools or rolls.

Specifically, the invention relates to splicing equipment for continuous strips of paper, tissue paper, plastic and the like coming from a pair of spools, in which the spools are provided for supplying, in turn, an outgoing strip with a first strip and a second strip toward a user apparatus, and in which the splicing equipment comprises a first cutting mechanism, a second cutting mechanism, a first splicing group and a second splicing group for forming the outgoing strip, by cutting and splicing, with the first strip or the second strip.

BACKGROUND OF THE INVENTION

Equipment of this type are used in systems for the treatment of continuous strips in which, for eliminating any stoppage of the user apparatus for roll changes and keeping the running at full speed and full productivity, it is necessary to splice the strip coming from a first spool to the strip coming from a second spool when the first spool is next to depletion. For this purpose, a terminal edge of the strip of a waiting full spool is manually prepared on a retention member of one of two splicing and cutting mechanisms. When the strip fed by the spool in process is about to run out, it is transversely cut and an initial edge retained by the retention member is spliced to the terminal edge prepared on the retention member. The terminal edge of the depleting spool is left idle for removal of the same spool and waiting for a full spool.

The splicing equipment of the known type for continuous strips of paper, tissue paper, plastic and the like coming from spools are more or less suitable to be employed in systems in which a single type of strip is substantially used so that a given spool is used from the beginning to the end.

Further, known splicing equipment have large dimensions in plan, the access to the splicing and cutting mechanisms results complex and the replacing of the depleted spools on respective unwinding devices can provide shifting of suspended loads.

In some fields regarding the treatment of paper web, as for example in the field of book on demand, there is the need of manufacturing books or brochures, even of a few pages, formed by paper of different features as weights or color, coming from paper rolls. This result was obtained by continuously exchanging the feed rollers in manual mode, with an increase in costs and a considerable lengthening of the working times.

SUMMARY OF THE INVENTION

An object of the invention is to provide equipment for splicing strips from a pair of strip spools for obtaining, in a fast and relatively inexpensive way, an outgoing strip formed by strip sections having of different typologies.

In accordance with this object, the splicing equipment comprises an output arresting mechanism actuatable for arresting the outgoing strip during the operations of cutting and splicing, a first applying device and a second applying device for a double sided adhesive film. The first splicing group and the second splicing group include a respective retaining member provided for retaining, after cutting and separation, an initial edge of the first strip or, respectively, for retaining, after separation, an initial edge of the second strip in preparation of splicing on a terminal edge of the outgoing strip and in which the first applying device and the second applying device are selectively actuatable for automatically depositing the double sided adhesive film) on the initial edge of the first strip or, respectively, on the initial edge of the second strip.

Another object of the invention is to provide equipment for splicing strips from a pair of strip spools which allows flexibility in use and ease of access to the functional components of the equipment and the unwinding devices, with relatively limited overall dimensions and which does not provide movement of suspended loads.

In accordance with this other object, the splicing equipment comprises two introduction and transferring devices for receiving the first strip and the second strip in a condition of tiling of a first unwinding device and a second unwinding device and to transfer, respectively, the first strip and the second strip to the first cutting mechanism, the second cutting mechanism, the first splicing group and the second splicing group.

BRIEF DESCRIPTION OF THE DRAWINGS

The characteristics of the invention will become clear from the following description, given purely by way of non-limiting example, with reference to the appended drawings in which:

FIG. 5 is a schematic drawing of the equipment of FIG. 2 in a fourth operative configuration while

DESCRIPTION OF THE PREFERRED EMBODIMENT

Figures 1, 1A:
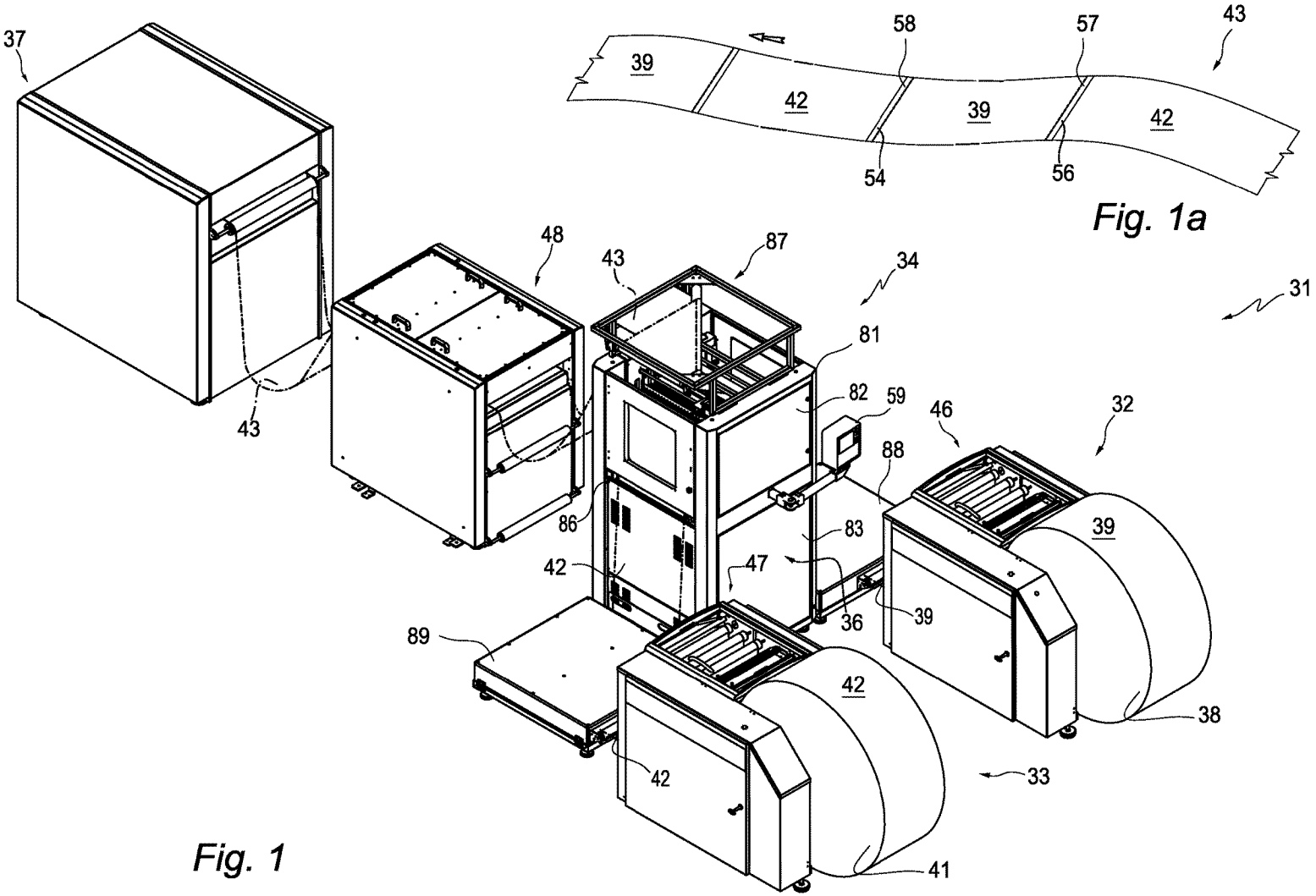
FIG. 1 shows a schematic view of part of a system for the treatment of strips, comprising splicing equipment for strips from a pair of spools, in accordance with the invention.
FIG. 1*a* is a view of a strip of FIG. 1.

FIG. 1 shows some parts of a system for the treatment of continuous strips or webs represented by 31. The system 31 comprises a first unwinding device 32 and a second unwinding device 33, splicing equipment 34, an electronic control unit 36 for the splicing equipment 34 and the unwinding devices 32 and 33 and a user apparatus for strips generically represented with 37.

The unwinding devices 32 and 33 are of known type and respectively support a first spool or roll 38 with a first continuous strip or web 39 and a second spool or roll 41 with a continuous second strip or web 42. The strips 39 and 42 are made of paper material such as paper, tissue paper, laminated paper or paperboard but can be in fabric, plastic and the like.

In operative conditions, the unwinding devices 32 and 33 unwind the strips 39 and 42 which enter into respective inputs of the splicing equipment 34. The equipment 34 in turn feeds the user apparatus 37 with an outgoing strip or web 43 formed by the strip 39 or the strip 42. Specifically, the equipment 34 has the function of splicing, after cutting, the strip 42 to the outgoing strip 43 formed by the strip 39 or splicing, after cutting, the strip 39 to the strip 43 formed by the strip 42.

The system for the treatment of strips 31 comprises a first input buffer 46 and a second input buffer 47 and an output buffer 48. The input buffers 46 and 47 are respectively disposed between the unwinding devices 32 and 33 and the splicing equipment 34 and operate on the first strip 39 and on the second strip 42 for compensating the velocity of the strips unwinding from the spools 38 and 41 with the velocity of the entering strips required by the user apparatus 37. In the herein described system 31, the input buffers 46 and 47 are integrated with the respective unwinding devices 32 and 33 as two unitary pieces of equipment.

The output buffer 48 is arranged between the splicing equipment 34 and the user apparatus 37 and operates on the outgoing strip 43 for compensating the velocity of the strip 43 outgoing from the equipment 34 with the velocity of the strip requested from by the apparatus 37. A de-tensioning device (not shown) can be used in alternative to the output buffer 48 in order to maintain the outgoing strip 43 at a predetermined tension during the operation of the apparatus 37.

The user apparatus 37 can be constituted by an initial component of a line for the manufacturing of books or documents. In particular, the equipment 37 may be constituted by a high speed printer for printing text and images on a clear outgoing strip 43. However, the equipment 37 may be constituted by a cutting apparatus for cutting an outgoing strip 43, where the strips 39 and 42 of the spools 38 and 41 have previously printed text and images.

Figure 9:
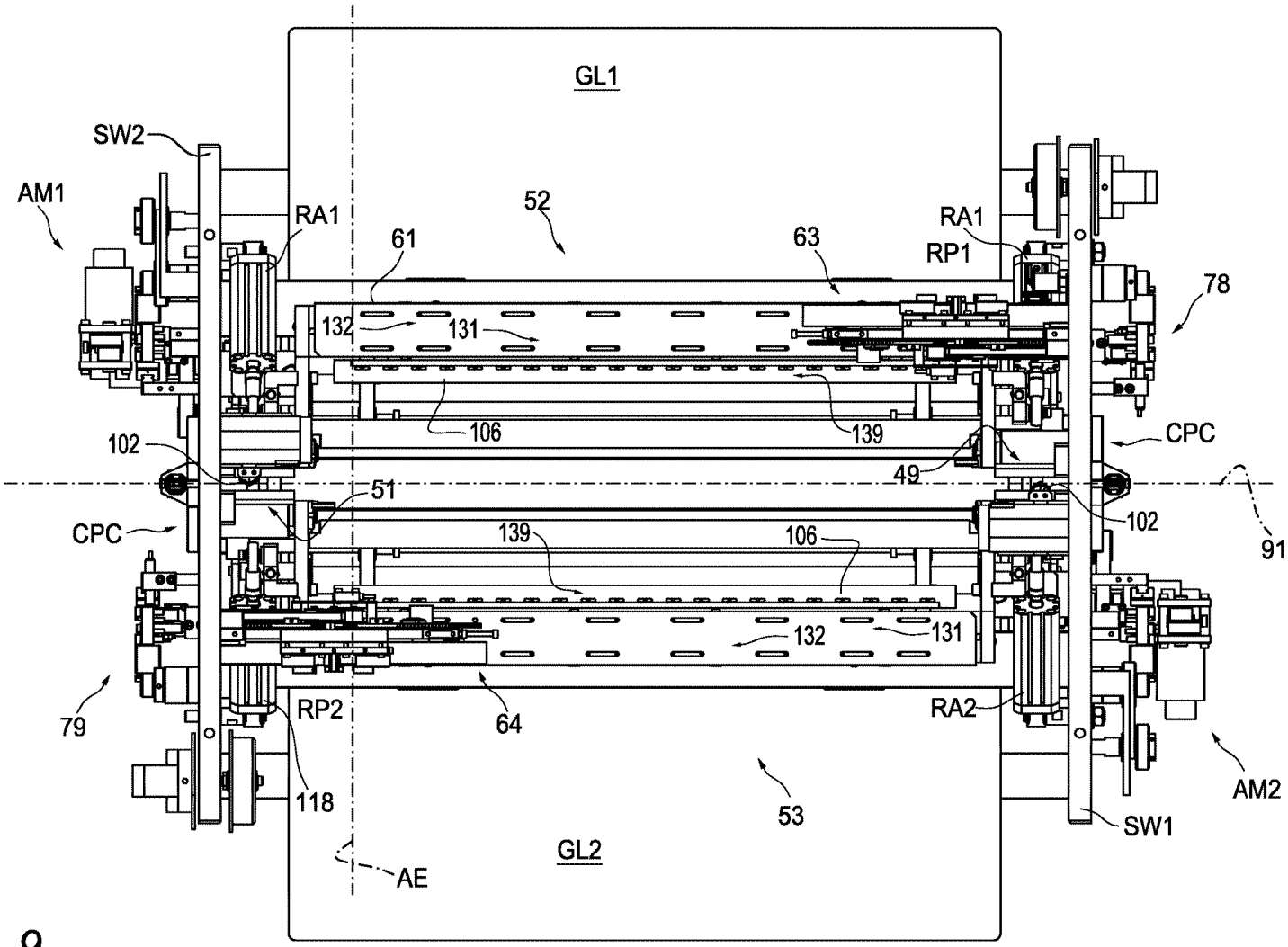
FIG. 9 shows a plan partial view of the splicing equipment in accordance with the invention.

In summary, the splicing equipment 34 (FIGS. 1, 2, and 9) comprises a first cutting mechanism 49, a second cutting mechanism 51, a first splicing group 52 and a second splicing group 53. The cutting mechanisms 49 and 51 and the splicing groups 52 and 53 are mounted between two lateral supporting walls SW1 and SW2 at the sides of the outgoing strip 43.

Figure 3A:
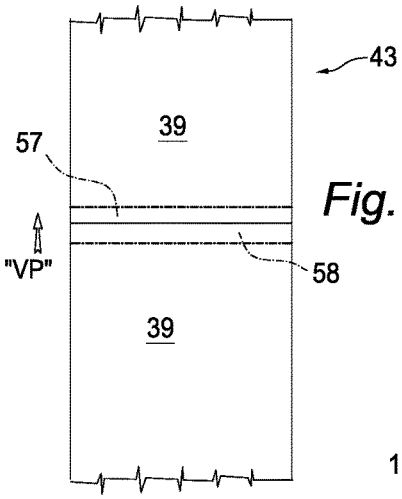
FIG. 3*a* is a view of a strip of FIG. 3.
Figure 7A:
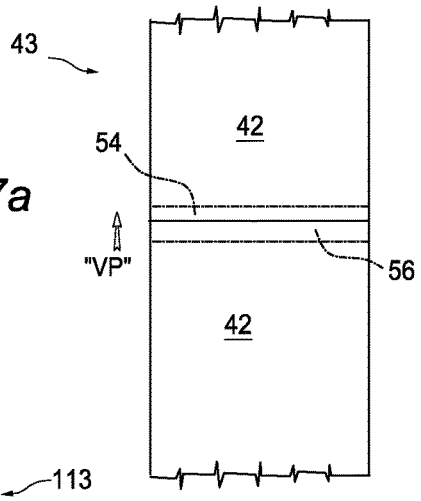
FIG. 7 is a schematic drawing of the equipment of FIG. 2 in a sixth operative configuration and FIG. 7*a* is a view of a strip of FIG. 7.

The first cutting mechanism 49 is actuatable for cutting the outgoing strip 43 formed with the second strip 42, defining a terminal edge 54 of the strip 42 (see FIG. 7*a*) as part of the strip 43, and an initial edge 56 of the strip 42 connected to the spool 41. Likewise, the cutting mechanism 51 is actuatable for cutting the outgoing strip 43 formed with the first strip 39, defining a terminal edge 57 of the strip 39 (see FIG. 3*a*) as part of the strip 43, and an initial edge 58 of the strip 39 connected to the spool 38.

Figure 4A:
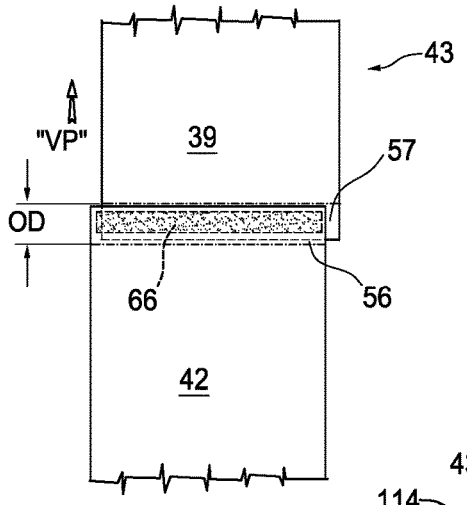
FIG. 4*a* is a view of strips of FIG. 4.
Figure 8A:
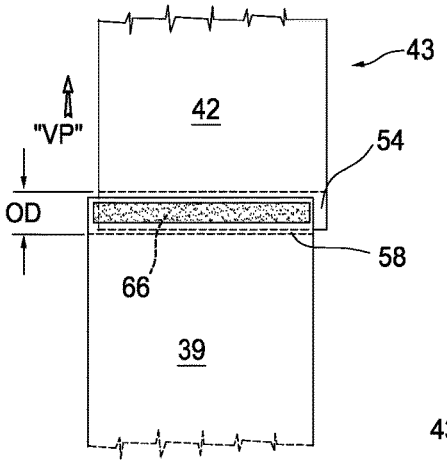
FIG. 8 is a schematic drawing of the equipment of FIG. 2 in a sixth operative configuration and FIG. 8*a* is a view of strips of FIG. 8.

The first splicing group 52 is actuatable for splicing the initial edge 58 of the first strip 39 on the terminal edge 54 of the second strip 42 (see FIG. 8*a*). In turn, the second splicing group 53 is actuatable for splicing the initial edge 56 of the second strip 42 on the terminal edge 57 (see FIG. 4*a*) of the first strip 39.

In accordance with the invention, the electronic control unit 36 is provided for actuating the first cutting mechanism 49 or the second cutting mechanism 51 and the first splicing group 52 or the second splicing group 53 so as to form the outgoing strip 43 (FIG. 1*a*) with sections of the first strip 39, alternated, on request, with sections of the second strip 42.

The operations of cutting and splicing are controlled by the electronic unit 36 on the basis of a remote or local program and/or by manual controls via a display terminal 59.

The first splicing group 52 (FIGS. 2, 5 and 9) and the second splicing group 53 include a respective retaining member 61 and 62 extending transversely between the walls SW1 and SW2 and designated for retaining the initial edge 58, inactive, of the strip 39 and, respectively, the initial edge 56, inactive, of the strip 42. The retaining members 61 and 62 are also provided for shifting the retained edges of the strip in a pre-setting position, suitable for a manual or automatic deposition of a splicing adhesive. It, in preparation of splicing the leading edge of the first strip 39 or the initial edge of the second strip 42 with the outgoing strip 43.

Figure 13:
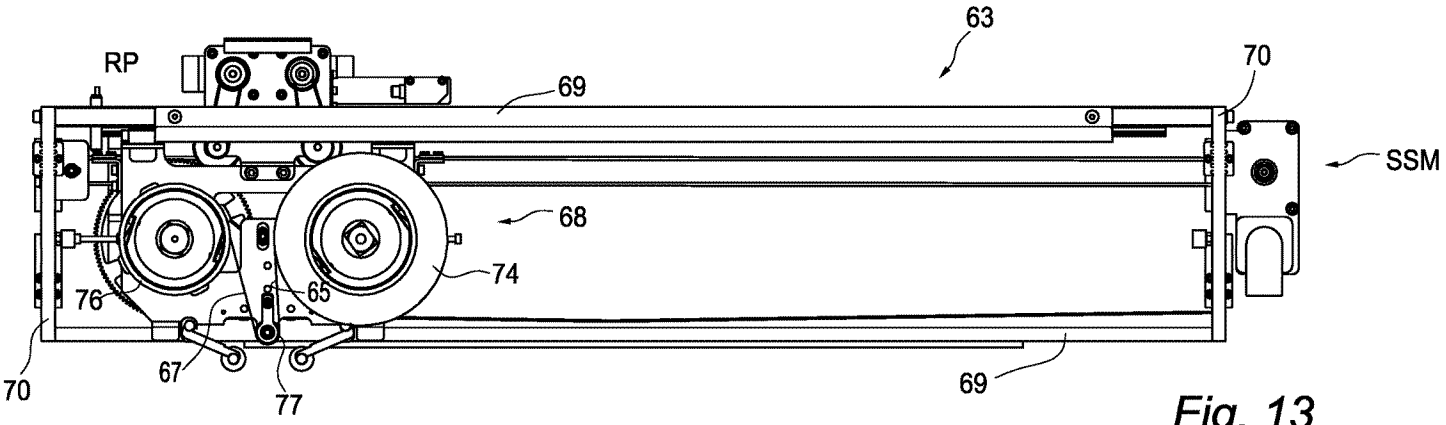
FIG. 13 is a partial rear view of some components of the equipment of FIG. 9.
Figure 14:
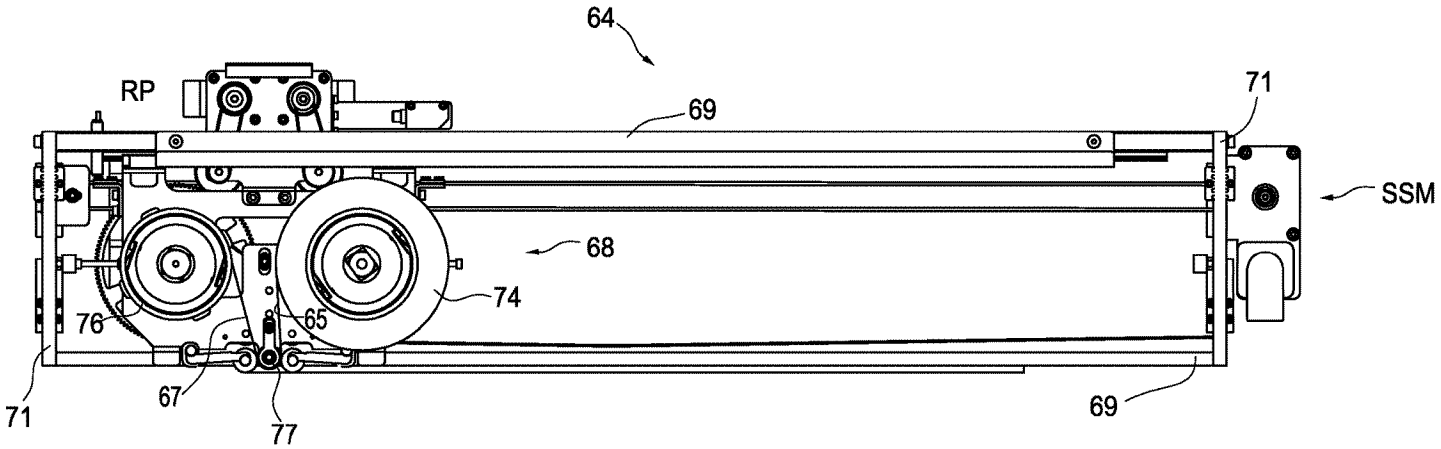
FIG. 14 is a partial front view of some components of the equipment of FIG. 9.
Figure 15:
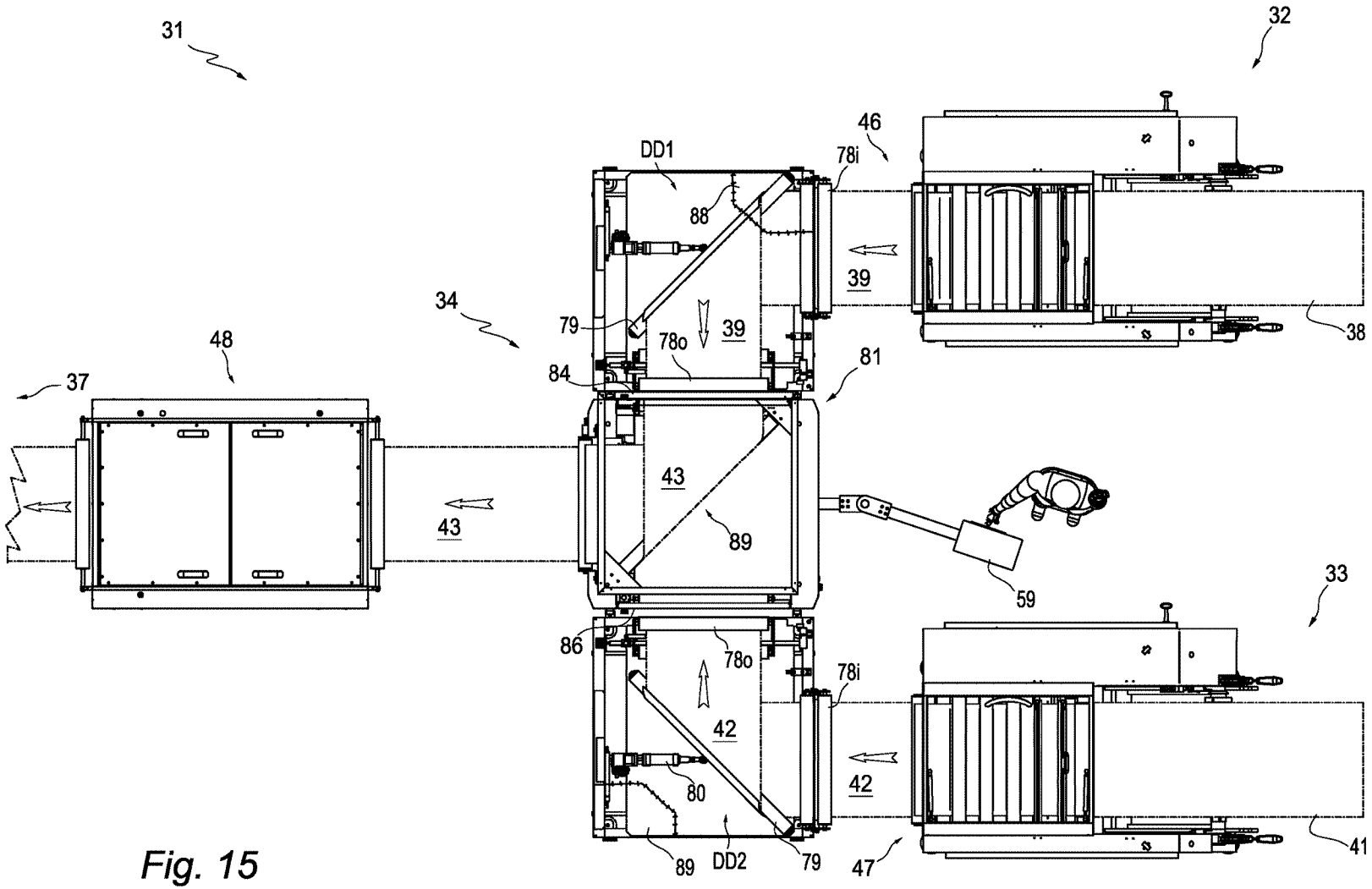
FIG. 15 shows a schematic plan view of part of a system for the treatment of strips, comprising the splicing equipment in accordance with the invention.

For an automatic deposition of adhesive, the splicing equipment 34 comprises a first applying device 63 (see FIGS. 13 and 14) and a second applying device 64 for a double sided adhesive ribbon 65. The ribbon 65 is of a commercial type, without support, with an adhesive film 66 and a strip of silicon paper (release liner) 67 of temporary support for the film 66 and to be taken up after fixing the film 66 on the edges to be prepared.

In synthesis, each applying device 63, 64 comprises an applying unit 68 which is slidably supported by horizontal rails 69 of a frame 70, 71. The frame 70, 71 extends transversely for a width greater than the outgoing strip 43 through respective openings of the walls SW1 and SW2. Two vertical guides with respective rails 72*a* and 72*b*, 73*a* and 73*b* mounted on the outside of the walls SW1 and SW2, slidably support the frame 70, 71 between an upper position HP, of rest, and a lower position LP, operative, for depositing the adhesive film 66.

Each applying unit 68 includes a supply spool 74 for the ribbon 65, a take-up spool 76 for the release liner 67 and an applying roller 77. In use, with the frame 71 in the position LP, the roller 77 presses the ribbon 65 on the initial edge of the strip 39, 42. According to a known technique, the applying unit 68 is displaceable transversely with respect to the strip 39 or 42 to be prepared for the splicing. In synchronism with the displacement of the unit 68, the take-up spool 76 winds the release liner 67 while the applying roller 77 fixes the adhesive film 66 on the initial edge of the strip to be prepared.

The frame 70, 71 is moved by a splicing actuation motor AM1 and AM2, via connections constituted by respective pairs of pulley and toothed belt mechanisms 78 and 79. In turn, each applying unit 68 is shifted by a respective applier shifting motor SSM through another pulley and toothed belt mechanism.

The applying device 63, 64 is actuatable by the electronic control unit 36 for applying the adhesive film 66 on the initial edge of the strip 39, 42 retained by the retaining member 61, 62. To this end, the electronic unit 36 actuates the motor AM1 for moving the frame 70, 71 from the upper position HP to the lower position LP. In sequence, the unit 36 actuates the motor SSM for advancing the applying unit 68 along the rails 69, starting from a rest position RP and across the width of the initial edge to be prepared, with deposition of the adhesive film 66. Finally, the control unit 36 commands the restoring of the frame 70, 71 to the HP position and the restoring of the unit 68 to its rest position RP.

The splicing equipment 34 (FIGS. 1, 2 and 9) has a containment structure 81 of substantially parallelepiped form, extended upwards, with an upper body 82 and a lower body 83. The upper body 82 houses the walls SW1 and SW2 with the cutting mechanisms 49 and 51, the splicing group 52 and the splicing group 53 and the applying devices 63 and 64, while the lower body 83 houses the electronic control unit 36, power electronic components, a pneumatic compressor (when a compressed air network is not available) and a vacuum Venturi effect generator, not shown in the drawings.

The upper body 82 of the structure 81 has two strip inputs 84 and 86 with rollers (not shown) and guiding plates GL1 and GL2 for the strips 39 and 42 on its lower part and is associated with a diverting group 87 on its upper part, while the lower body 83 on its lower part is associated to a first platform 88 and a second platform 89 accessible to operators. The upper body 82 also has two windows above the platforms 88 and 89, of access to the cutting mechanisms 49 and 51, the splicing groups 52 and 53 and the applying devices 63 and 64. This is to make easier the operations of initialization and maintenance.

The arrangement of the cutting mechanisms 49 and 51 and the splicing groups 52 and 53 is symmetrical with respect to a vertical geometric plane 91, of reference, perpendicular to the walls SW1 and SW2, and in which the platforms 88 and 89 are arranged on opposite sides with respect to the plane 91.

The strips 39 and 42 coming from the spools 38 and 41 enter below the platforms 88 and 89, with output from a respective edge parallel to the plane 91, and are diverted upwards along two vertical walls of the body 83 up to the strip inputs 84 and 86. The outgoing strip 43 emerges from a slit 92 of the body 82 and, after divertion by the diverting group 87 is directed towards the user apparatus 37.

For a plan containment in the dimensions of the system 31, the unwinding devices 32 and 33 with the input buffers 46 and 47 are arranged side by side. In particular the unwinding devices are installed on the floor, adjacent to a respective edge of the platforms 88 and 89 contiguous to the output edge for the strips 39 and 42 and leave a free space for the terminal 58 and of access to the operators.

Two diverting devices DD1 and DD2 are suitably arranged beneath the platforms 88 and 89 for providing a deviation of 90° to the path of the strips 39 and 42. In particular, the diverting devices DD1 and DD2 define an input port with input rollers 78*i* and an output port with output rollers 78*o* arranged at a short distance from the floor of support for the equipment 34 and the unwinding devices 32 and 33. The input rollers 78*i* receive the strip coming from a respective unwinding device, while the output rollers 78*o* are of output for the strip directed to the cutting and splicing members. A diverting roller 79 is arranged substantially at 45° with respect to the rollers 78*i* and 78*o* and is provided to be moved by a servo motor 80 with respect to the rollers 78*i* and 78*o*.

The strips 39 and 42 coming from the unwinding devices 32 and 33 are driven, at the entrance, by the rollers 78*i*, diverted of 45° by the diverting roller 79 and are guided at the output by the output rollers 78*o*. A series of side margins sensors constituted by photoelectric pairs 85 near the ends of the output rollers 78*o* detect the positions of the edges of the strips 39 and 42 emerging from the same rollers 78*o* and directed to the inputs 84 and 86.

In turn, the electronic control unit 36 actuates the servomotor 80, on the basis of the program and in response to the information from the photoelectric pairs 85, by shifting the diverting roller 79 so as to align an edge of the strips 39 and 42 with a common alignment geometric plane AE of the equipment 34.

Downstream of the inputs 84 and 86, the strips 39 and 42 are guided by the respective guiding plates GL1 and GL2 and diverted upward by means of, respectively, two low and high transversal rollers 93 and 94 and two low and high transversal rollers 96 and 97. A converging wedge 98 and a separating lamina 99 in axis with the plane 91 are arranged to define a common vertical path VP for the strips 39 and 42, with upward movement tangential to the plane 91.

A splicing area SA in the path VP above the lamina 99 defines a space for the operations of cutting and splicing of the strip 39 with the strip 43 formed by the strip 42 or the operations of cutting and splicing of the strip 42 with the strip 43 formed by the strip 39. A pair of motor rollers 101, downstream of the area SA, transport the outgoing strip 43 towards the diverting group 87, with output through the slit 92.

The first cutting mechanism 49 and the second cutting mechanism 51 each include a cutting element 102 which is actuatable for executing a transverse cut on the outgoing strip 43 in the splicing area SA. In particular, each cutting element 102 is constituted by a blade with a double angle cutting edge mounted on a carriage 103 which is slidable on a horizontal rail 104 arranged transversely to the path VP of the strip 43. A double effect pneumatic cylinder CPC is actuatable by the electronic unit 36 for shifting the carriage 103 from one side to the other of the strip 43 along the rail 104 between two positions of rest external to the path VP, for executing cuts of the strip 43 from right to left, and vice versa, from left to right.

The retaining member 61, 62 is designated to be positioned between a contrast position CP1, CP2, substantially vertical, adjacent to the reference plane 91 in the splicing area SA and a splicing pre-setting position PP1, PP2, substantially horizontal, spaced away from the plane 91. The retaining members 61 and 62 are driven by two respective pairs of actuators RA1 and RA2 of pneumatic type.

In the contrast position CP1, CP2, the retaining member 61, 62 has a support function for the strip 42, 39 against the action of the cutting element 102 for cutting the outgoing strip 43. For safety's sake, a transversal lamina 105 is temporarily displaceable along the plane 91 by a pair of pneumatic rams LPP from a rest position, adjacent to the separating lamina 99 to an upper position, below the path of the cutting element 102, of support for the strip 42, 39 and of contrast for the retaining member 61, 62. After the cutting, the blade 105 is restored to its rest position.

At the end of the cutting and in the contrast position CP1, CP2, the retaining member 61, 62 has a contrast function to the other retaining member 62, 61 for a pressing splicing of the initial edge 56 on the terminal edge 57 and of the initial edge 58 on the terminal edge 54. This action is particularly effective and allows the splicing on the outgoing strip 43 of not disturbing the operation of any ink jet print heads in the case where an ink jet printing is provided on the same tape 43 downwards from the equipment 34.

In the splicing pre-setting position PP1, PP2, the retaining member 61, 62 has retaining function for the respective inactive initial edge 58, 56 of the strip 39, 42 and contrast function for a manual or automatic application of the adhesive on the same initial edge 58, 56.

The splicing is carried out by superposition of the initial edges 56 and 58 of the strips 42 and 39 with respect to the terminal edges 57 and 54 of the strips 39 and 42 which form the outgoing strip 43. These splicings interest an overlapping width OD associated to the width of the adhesive film 66.

Figure 5A:
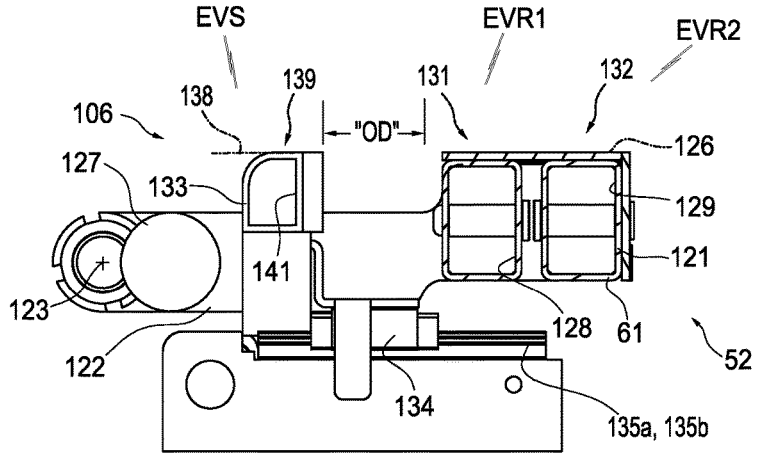
FIG. 5*a* is a schematic drawing in an enlarged scale of a detail of FIG. 5.

The first splicing group 52 and the second splicing group 53 comprise a respective edge shifting member 106 and 107 for shifting the initial edge 58 or 56 of inactive strip retained by the retaining member 61 or 62 by an amount corresponding to the overlapping width OD (See FIG. 5*a*).

A first recovery member 108 and a second recovery member 109 are provided for recovering a portion of the strip 39, 42 corresponding to the overlapping width OD. The recovery member 108 is operative between the first entering strip 39 and the first splicing group 52, while the recovery member 109 is operative between the second entering strip 42 and the second splicing group 53.

Conveniently, the splicing equipment 34 comprises two input arresting mechanisms 111 and 112 for arresting, respectively, the first strip 39 and the second strip 42 and an output arresting mechanism 113 for arresting the outgoing strip 43 in steps of cutting and splicing. The input arresting mechanisms 111 and 112 each comprise, respectively, a pair of pneumatically operated pads PL1 and PL2 which operate on the strips 39 and 42, contrasted by the guide plates GL1 and GL2, close to the strip inputs 84 and 86. The output arresting mechanism 113 includes another pneumatically operated pad PL3 which operates on the outgoing strip 43 upstream of the motor rollers 101, against a contrast bar 114.

The input buffers 46 and 47 limit the accelerations of the strips 39 and 42 unwinding from the respective spools 38 and 41 during temporary arrests by the mechanisms 111 and 112 on the cutting and splicing steps and the final arrest of the inoperative strip. The output buffer 48, in turn, ensures a continuous feed of the user apparatus 37 during temporary arrests of the outgoing strip 43 by the output arresting mechanism 113, on the steps of cutting and splicing.

The restraining action of the initial edges of the strips 39 and 42 by the retaining members 61 and 62 and the edge shifting members 107 and 108 is obtained through suction holes of those members connected to the vacuum generator of the equipment 34.

In detail, each retaining member 61, 62 is formed by a hollow beam 121 of parallelepiped section, with length at least equal to the maximum width of the strips 39, 42 and width corresponding to twice the overlapping width OD. The beam 121 is fixed as a cross to two arms 122, which pivot about an axis 123 adjacent to the plane 91 and driven for rotation by pneumatic actuators RA1 and RA2. On an upper part, the beam 121 supports a rubber layer 124 (FIG. 5*a*) which defines a support and sealing surface 126 for the initial edge 58, 56. The rubber layer 124 extends substantially through the entire width of the beam 121 and constitutes a contrast, with engraving, for the cutting element 102 in correspondence of its center line. Further, a guiding roller 127 of guide for the strip 39, 42 is fixed between the arms 122, near the axis 123, in the position PP1, PP2 of splicing pre-setting for the retaining member 61, 62.

Inside, each beam 121 defines two sealed independent chambers 128 and 129, connected to the vacuum generator via solenoid valves EVR1 EVR2. The sealed chambers 128 and 129 have on an upper part two respective rows of suction holes 131 and 132 which pass through the rubber layer 124. The rows of holes 131 and 132 are parallel to each other and to a generatrix of the beam 121 and are spaced apart relative to one another by a distance associated with the overlapping width OD between the terminal edges and the initial edges of the strips 39, 42 to be spliced.

Figure 10A:
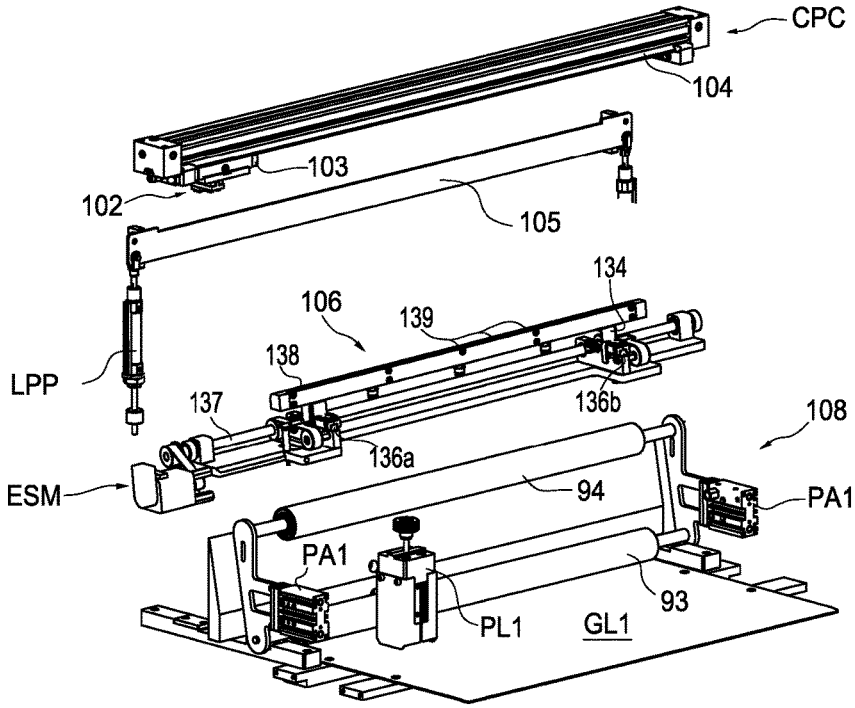
FIG. 10*a* is an exploded view of some components of the equipment of FIG. 9.

The edge shifting member 106, 107 is formed by a hollow beam 133, of parallelepiped section, also of a length at least equal to the maximum width of the strips 39, 42 and having a rounded corner. The beam 133 is mounted on a frame 134, in turn slidable on two horizontal rails 135*a* and 135*b* (see FIG. 5*a*) arranged at the sides of the path VP, perpendicular to the vertical plane 91. Each frame 134 (see FIG. 10*a*) is moved by a corresponding edge shifting motor ESM via two pulley and toothed belt connections 136*a* and 136*b*, adjacent to the rails 135*a* and 135*b* and connected to each other via a common shaft 137. Thus, relative to the retaining member 61, 62 in the splicing pre-setting positions "PP1," "PP2," the edge shifting member 106, 107 is movable from a rest position in which the hollow beam 133 is spaced from the beam 121 to an operative position in which the beam 133 is close to the beam 121.

On an upper part, the hollow beam 133 presents a support and sealing surface 138 for the initial edge 58, 56 having a row of suction holes 139 aligned parallel to a generatrix of the same beam 133. The holes 139 are in connection with a sealed chamber 141, internally to the beam 133, which is connected with the vacuum generator through a solenoid valve EVS.

The support and sealing surface 138 of the edge shifting member 106, 107 is substantially coplanar with the support and sealing surface 126 of the retaining member 61, 62 in the splitting pre-set positions PP1, PP2.

In particular, the stroke of the frame 134 between the rest position and the operative position of the edge shifting member 106, 107 corresponds to the overlapping width OD between the edges to be spliced of the strips 39 and 42.

The recovery members 108 and 109 are constituted, for example, by respective carriages of support for the transversal rollers 93 and 94 and for the transversal rollers 96 and 97. The members 108 and 109 are movable by pneumatic actuators PA1 and PA2 between a rest position and a retrieval position, respectively associated to the rest position and the operative position of the edge shifting member 106, 107. The rollers 93 and 94 and, respectively, the rollers 96 and 97 are adjacent to the convergence wedge 98 in the position of rest, while they are away from the wedge 98 in the recovery position.

The pneumatic actuators RA1 and RA2 of the retaining members 61 and 62, the pneumatic cylinders CPC for the cutting elements 102, the pneumatic pads PL1, PL2 and PL3 for the arresting mechanisms 111, 112 and 113 and the pairs of pneumatic actuators PA1 and PA2 for the recovery members 108 and 109 are connected to the pneumatic compressor and are controlled by solenoid valves (not shown), in turn actuated by the electronic control unit 36. The edge shifting motor ESM for the edge shifting members 106 and 107, the splicing actuating motors AM1 and AM2 for the frames 70 and 71 and the applier shifting motors SSM for the applying devices 63 and 64 are of servo-assisted type and are also controlled by the electronic unit 36.

The characteristics of the first strip 39 can be also dimensionally different from the ones of the second strip 42. For optimizing the splicing of these strips, the control unit 36 responds to information from the margin sensors constituted by the photoelectric couples 85 for limiting the stroke of the adhesive deposition to the width of the narrower and in association with the alignment plane AE.

Operation

Figures 2, 2A:
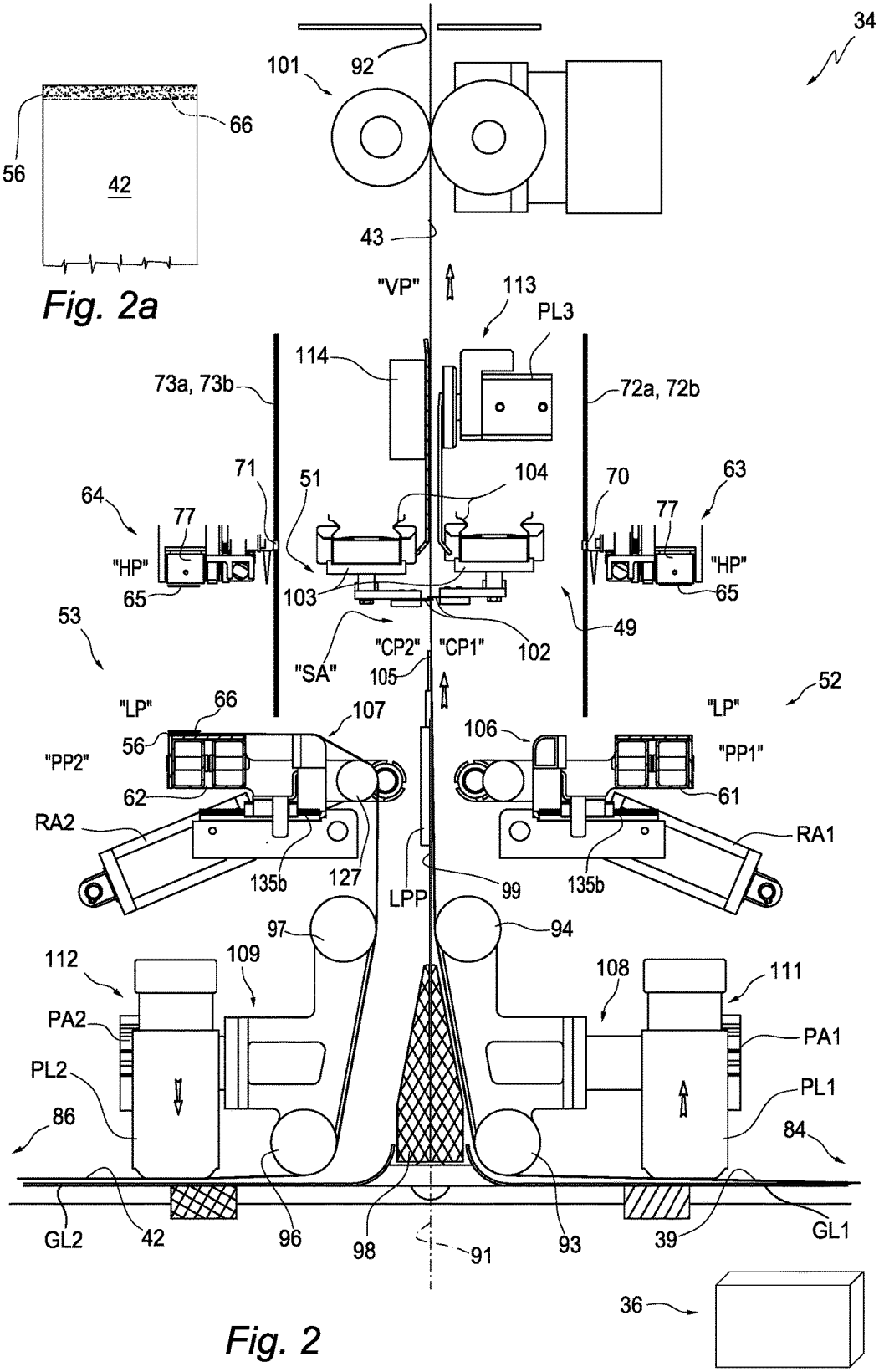
FIG. 2 represents a schematic drawing of the splicing equipment in accordance with the invention, in a first operative configuration.
FIG. 2*a* is a view of a strip used in FIG. 2.

With reference to FIGS. 1 and 2, the splicing equipment 34 is represented in a configuration in which the outgoing strip 43 is formed by the first strip 39 for requests of the user apparatus 37 for this kind of strip. The first unwinding device 32 is operative and unwinds the strip 39, while the second unwinding device 33 is stationary and the strip 42 is ready for splicing to the strip 39.

In the splicing groups 52 and 53, the retaining members 61 and 62 are in the respective splicing pre-setting positions "PP1" and "PP2," the applying devices 63 and 64 are in the "HP" positions and the input arresting mechanism 112 locks the strip 42 against the guide plate GL2. The retaining member 61 is inactive, while the retaining member 62 retains, by the action of the vacuum, the initial edge 56 of the second strip 42 on which the adhesive film 66 has already been deposited (FIG. 2*a*) and is ready for the splicing. The edge shifting member 107 and the recovery member 109 are in their respective rest and recovery positions, and the edge shifting member 106 is in the rest position while the recovery member 108 is in its operative position.

Figure 3:
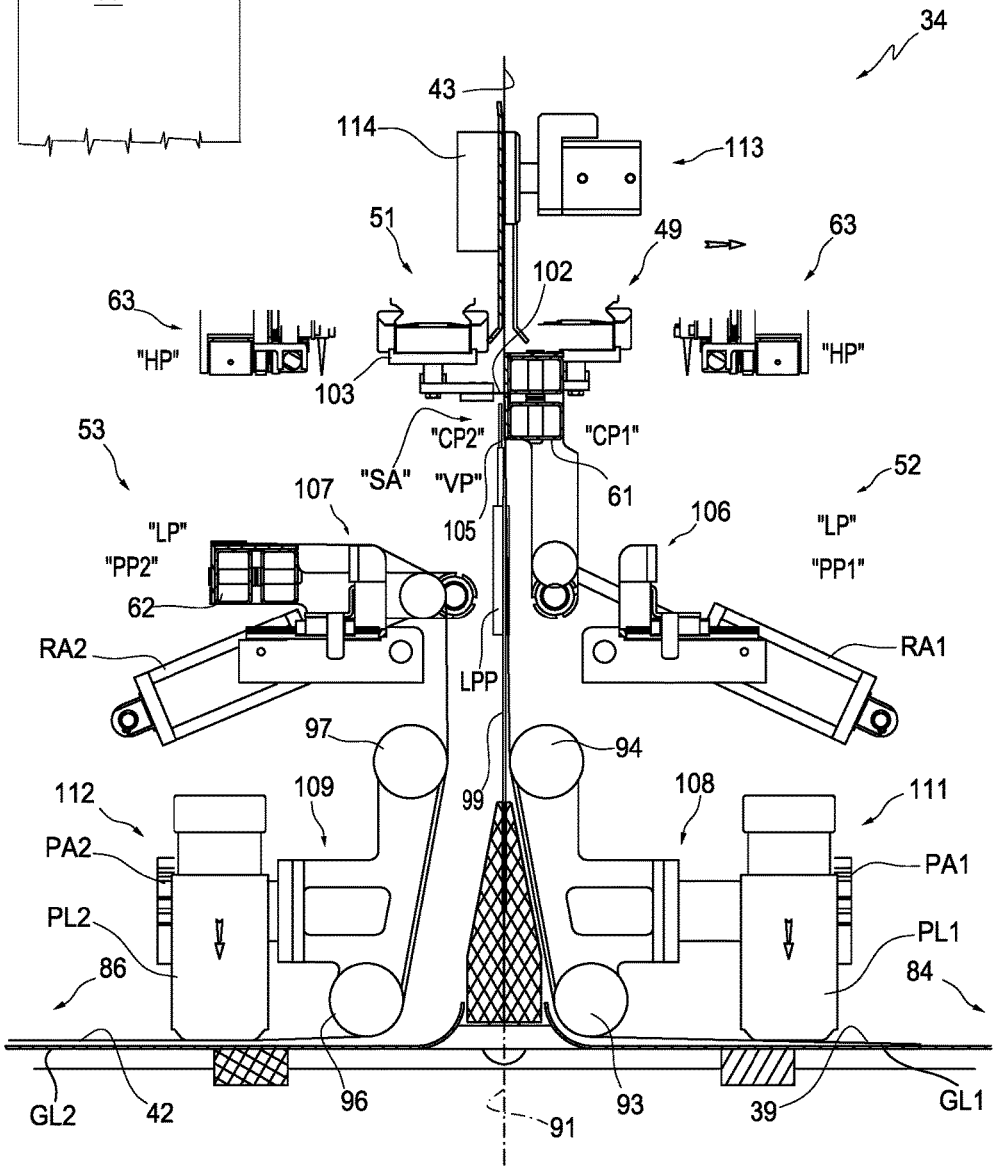
FIG. 3 is a schematic drawing of the equipment of FIG. 2 in a second operative configuration.

For applications of the user apparatus 37 requesting the strip 42, after the use of the strip 39, the electronic control unit 36 actuates the pneumatic pad PL1 of the input arresting mechanism 111 and the pneumatic pad PL3 of the output arresting mechanism 113. In particular, it arrests the unwinding device 32, with block of the strips 39 and 43 (FIG. 3) in a predefined position with respect to the splicing area "SA" in response to information from by suitable sensors of known type. Then, the electronic unit 36 actuates the solenoid valves for the pair of pneumatic actuators RA1, causing the rotation of the retaining member 61 in the contrast position "CP1" with the surface 126 in contact with the strip 39, and actuates the pneumatic rams LPP, bringing the transverse plate 105 in front of the retaining member 61. Now, the electronic unit 36 actuates the pneumatic cylinder CPC with shifting of the cutting elements 102 of the cutting mechanism 51, cutting of the strip 39 (FIG. 3*a*) and definition of the terminal edge 57 and the initial edge 58. The solenoid valves EVR1 and EVR2 (FIG. 5*a*) are also actuated and connect the sealed chambers 128 and 29 with the vacuum generator ensuring a tight adherence of the two separated terminal edges 57 and 54 with the surface 126.

Figure 4:
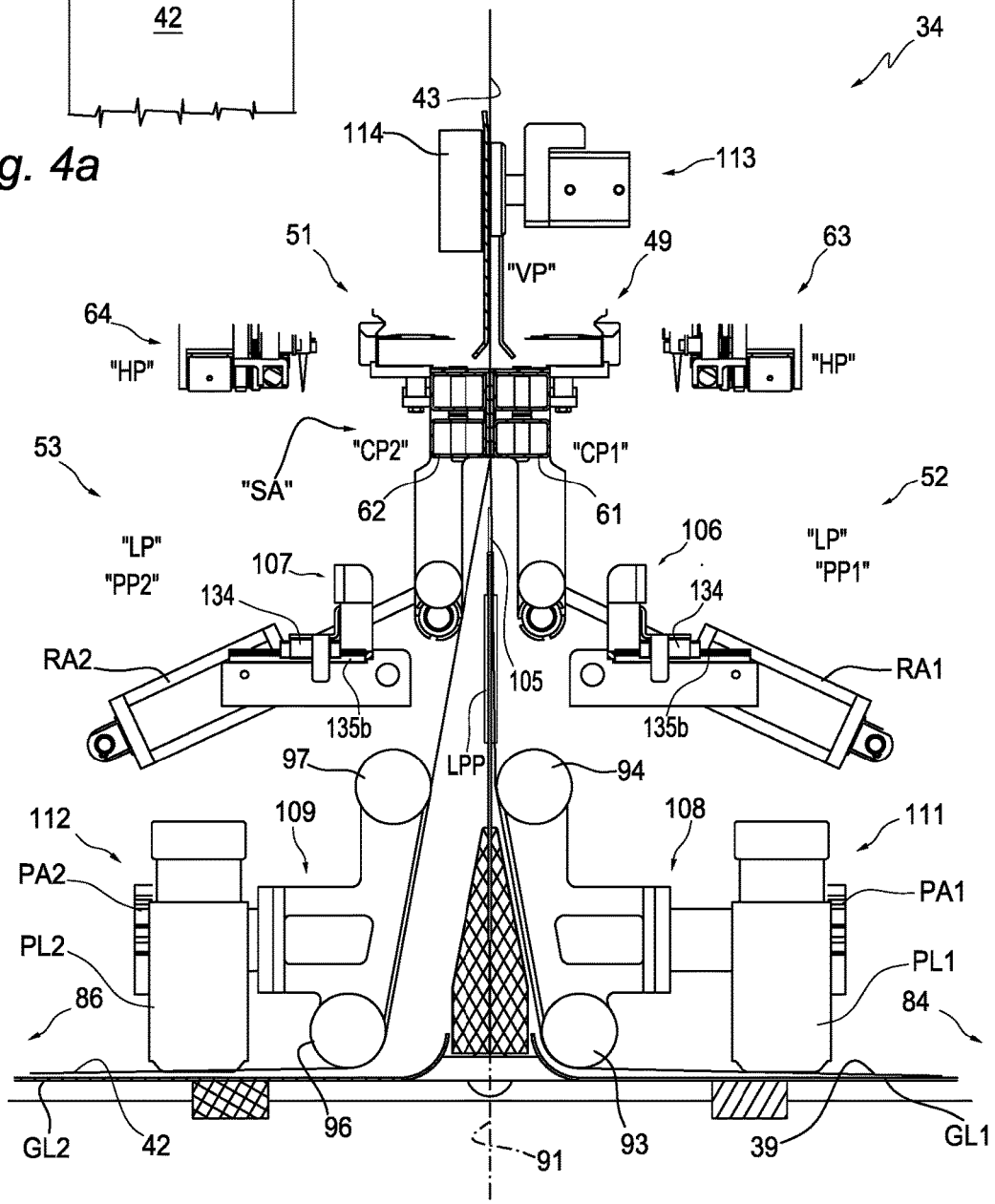
FIG. 4 is a schematic drawing of the equipment of FIG. 2 in a third operative configuration.

The electronic unit 36 now actuates the solenoid valves for the pneumatic rams LPP, with return to rest of the transversal lamina 105, and the solenoid valves for the pneumatic actuators RA2 (FIG. 4), causing the rotation of the retaining member 62 up to the contrast position "CP2," with pressure of the initial edge 56 of the strip 42 with the adhesive film 66 against the terminal edge 57 of strip 39 (FIG. 4*a*), so as to carry out the splicing of the strip 42 to the strip 39, and define the outgoing strip 43 with the strip 42.

The electronic unit 36 now puts the sealed chambers of the retaining member 62 to ambient pressure and actuates the solenoid valves for the actuators RA2 restoring the retaining member 62 (FIG. 5) to the splicing pre-setting position "PP2." Then the electronic control unit 36 releases the arresting mechanisms 112 and 113, actuates the second unwinding device 33 for feeding the user apparatus 37 with the second strip 42 and starts the preparation of an initial edge of the first strip 39 for a new splicing.

Figure 5:
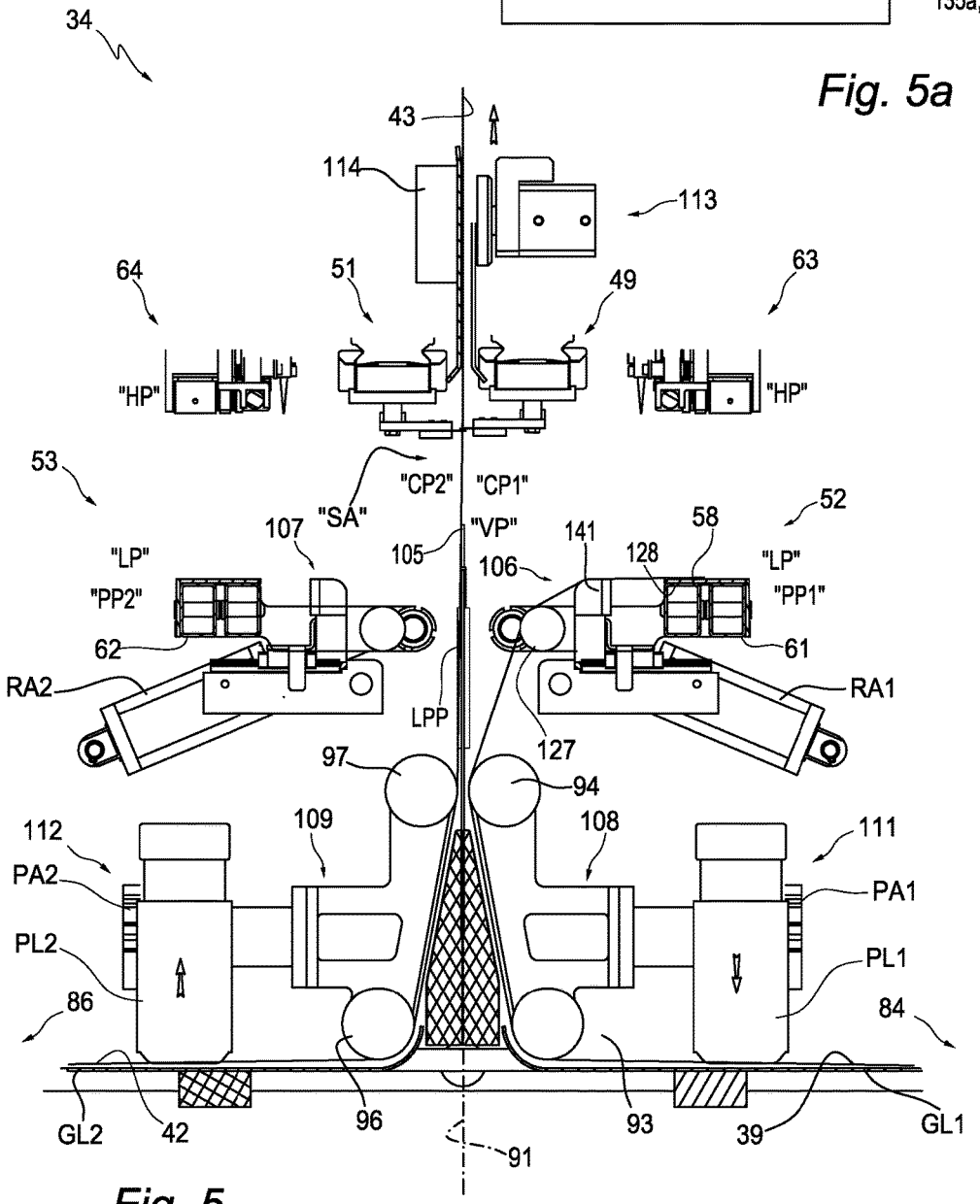
Figure 6A:
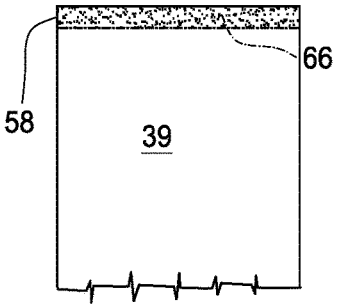
FIG. 6 is a schematic drawing of the equipment of FIG. 2 in a fifth operative configuration and FIG. 6*a* is a view of a strip of FIG. 6.
Figure 6:
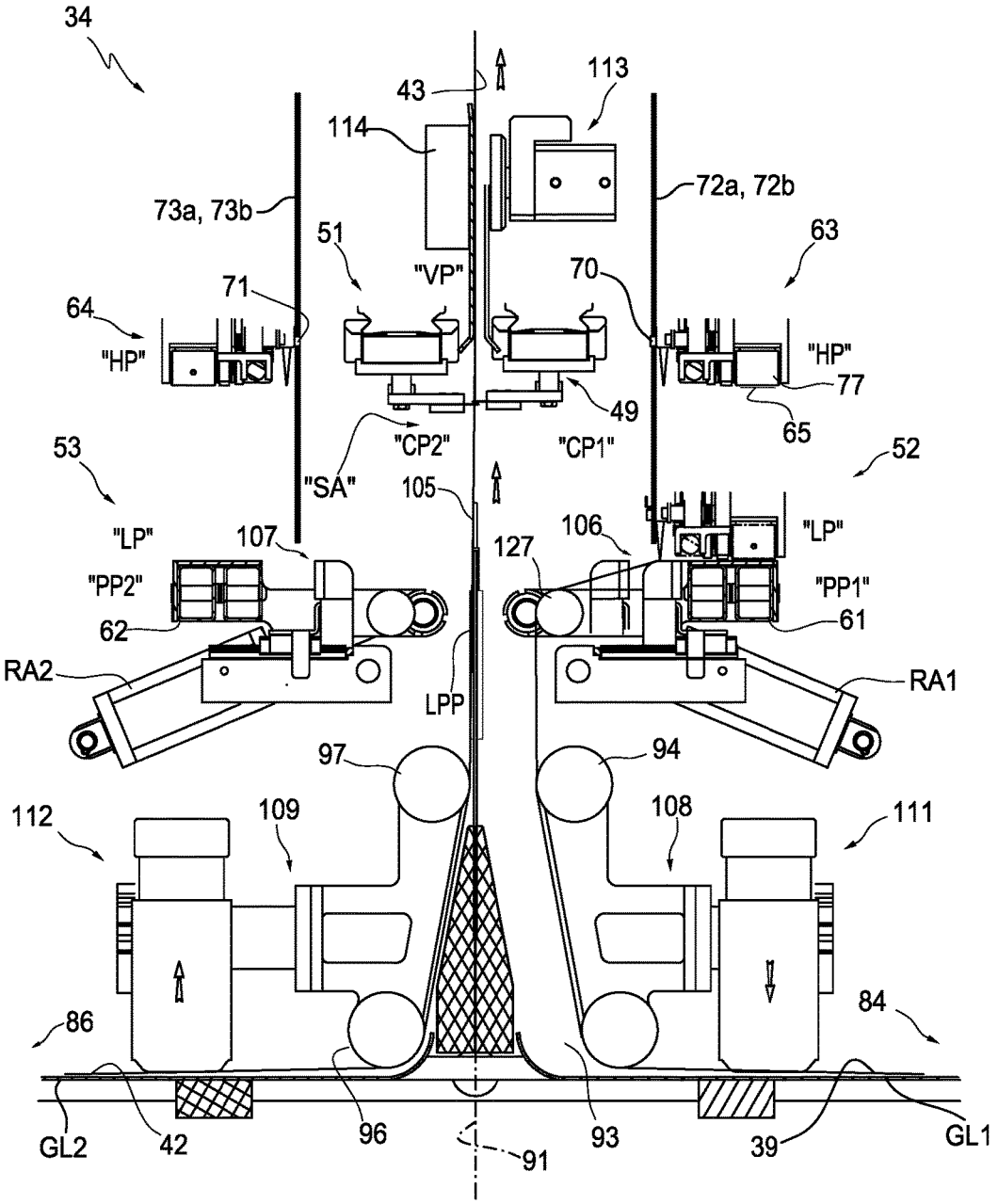

Specifically, while the user apparatus 37 operates on the strip 42, the electronic unit 36 puts the sealed chamber 129 (FIG. 5*a*) of the retaining member 62 at ambient pressure, while maintains the vacuum on the sealed chamber 128 and actuates the solenoid valves for the pair of actuators RA1 (FIGS. 5 and 5*a*) shifting the retaining member 61 on the splicing pre-setting position "PP2." The strip 39 bears on the guiding roller 127 with the initial edge 58 retained by the vacuum through the holes 131 of the sealed chamber 128. The electronic unit 36 now actuates the solenoid valves EVS and EVR2, moving the edge shifting member 106 for the overlapping width "OD" on its operative position (FIGS. 5 and 6). The initial edge 58 slides above the sealed chamber 129, retained on the surfaces 138 and 126 by the action of the vacuum through the holes 139 and 132, while the recovery member 108 is moved on its recovery position. At the end of the spacing, the edge shifting member 106 is restored to rest, with de-actuation of the solenoid valve EVS.

Figure 10:
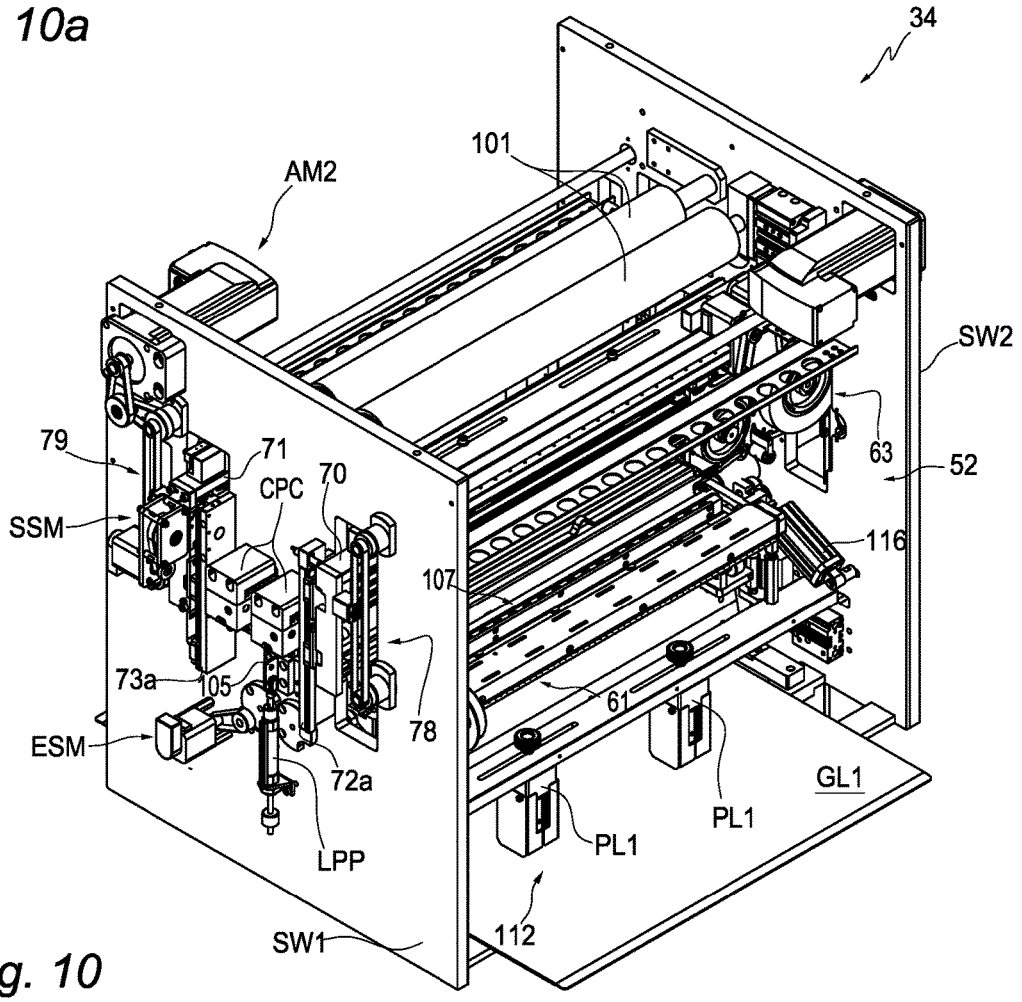
FIG. 10 represents a partial rear perspective view of the equipment of FIG. 9.
Figure 11:
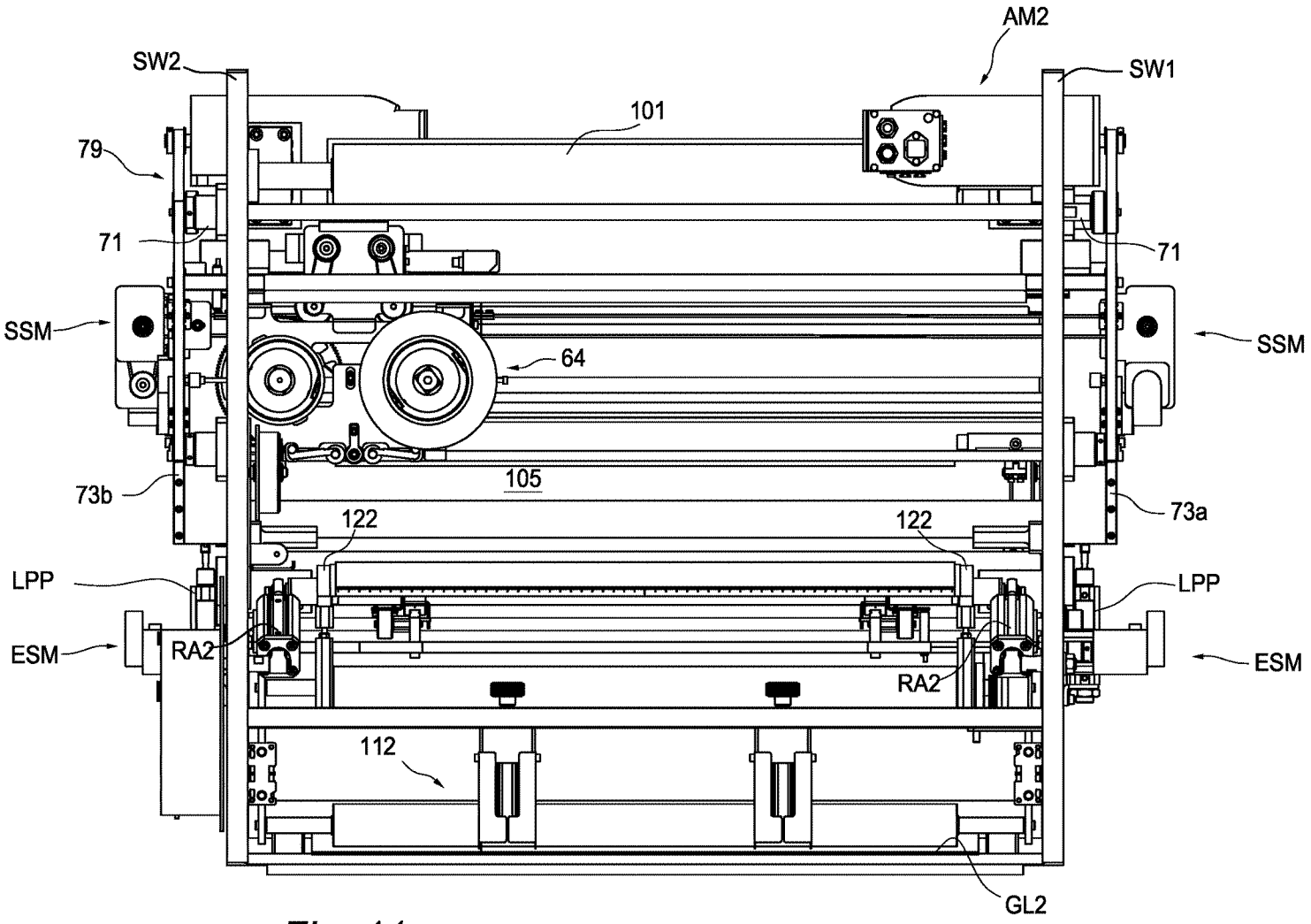
FIG. 11 shows a partial front view of the splicing equipment in accordance with the invention.
Figure 12:
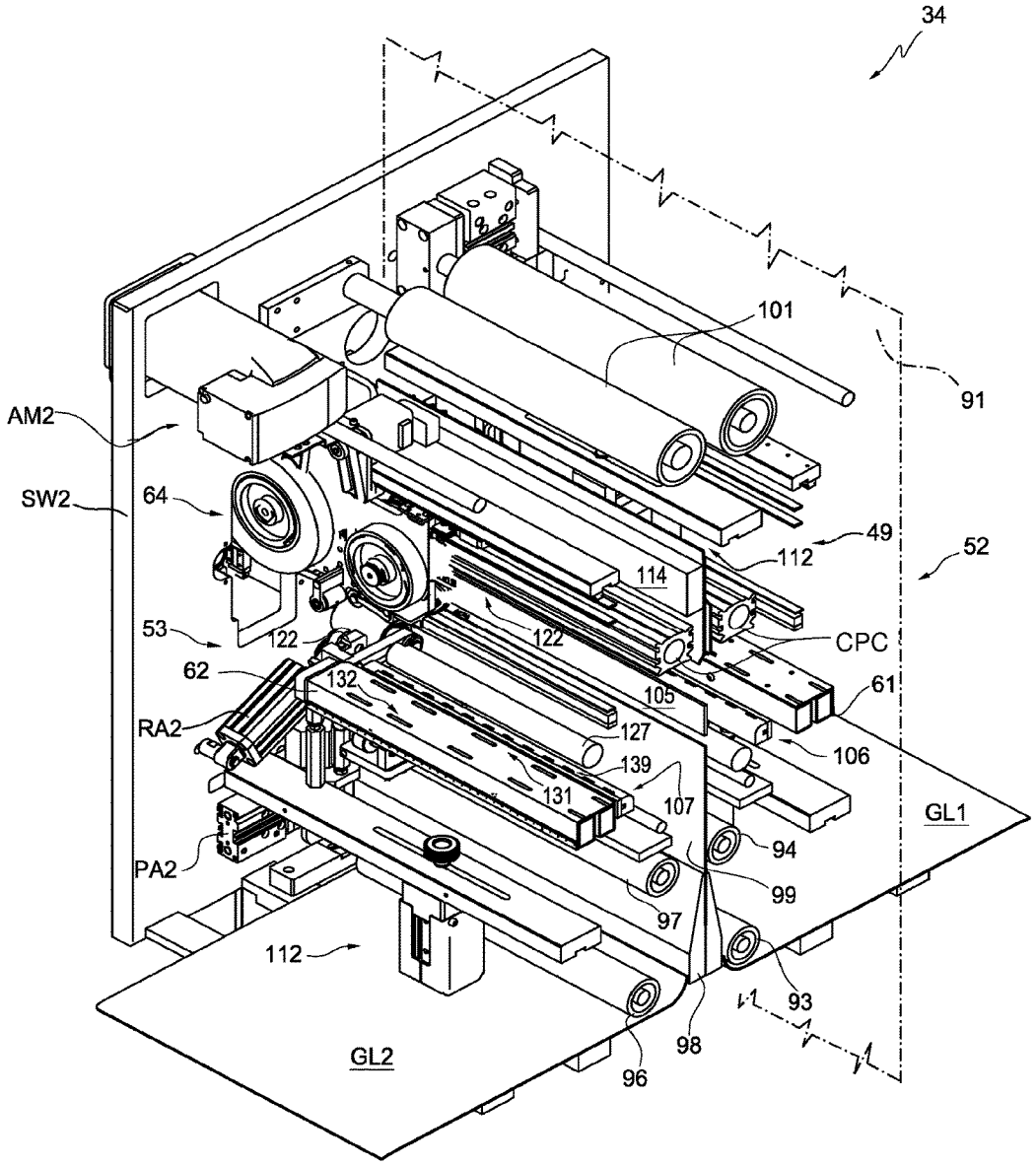
FIG. 12 is a partial front perspective view, with sections, of the equipment of FIG. 9.

The electronic unit 36 now actuates the motor AM1 of the first applying device 63 (FIGS. 6, 10 and 11) for moving the frame 70 along the rails 72*a* and 72*b* from the position "HP" to the position "LP" and pressing the adhesive ribbon 65 on the initial edge 58 of the strip 39 by means of the applying roller 77. In sequence, the electronic unit 36 actuates the applier shifting motor SSM for moving the applying unit 68 along the retention member 62 while, in synchronism, the take-up spool 76 wraps the release liner 67 and the applying roller 77 deposes and fixes the adhesive film 66 on the initial edge 58 of the strip 39. At the end of the deposition, the applying unit 68 and the frame 70 are restored, respectively, to the rest position RP and the position HP.

In these conditions, the splicing equipment 34 is in a configuration in which the outgoing strip 43 (FIG. 6) is formed by the second strip 42 for applications of the user apparatus 37 requiring this kind of strip. The first unwinding device 32 is stopped, the second unwinding device 33 unwinds the strip 42 while the first strip 39 is ready for a splicing to the strip 42.

Figure 7:
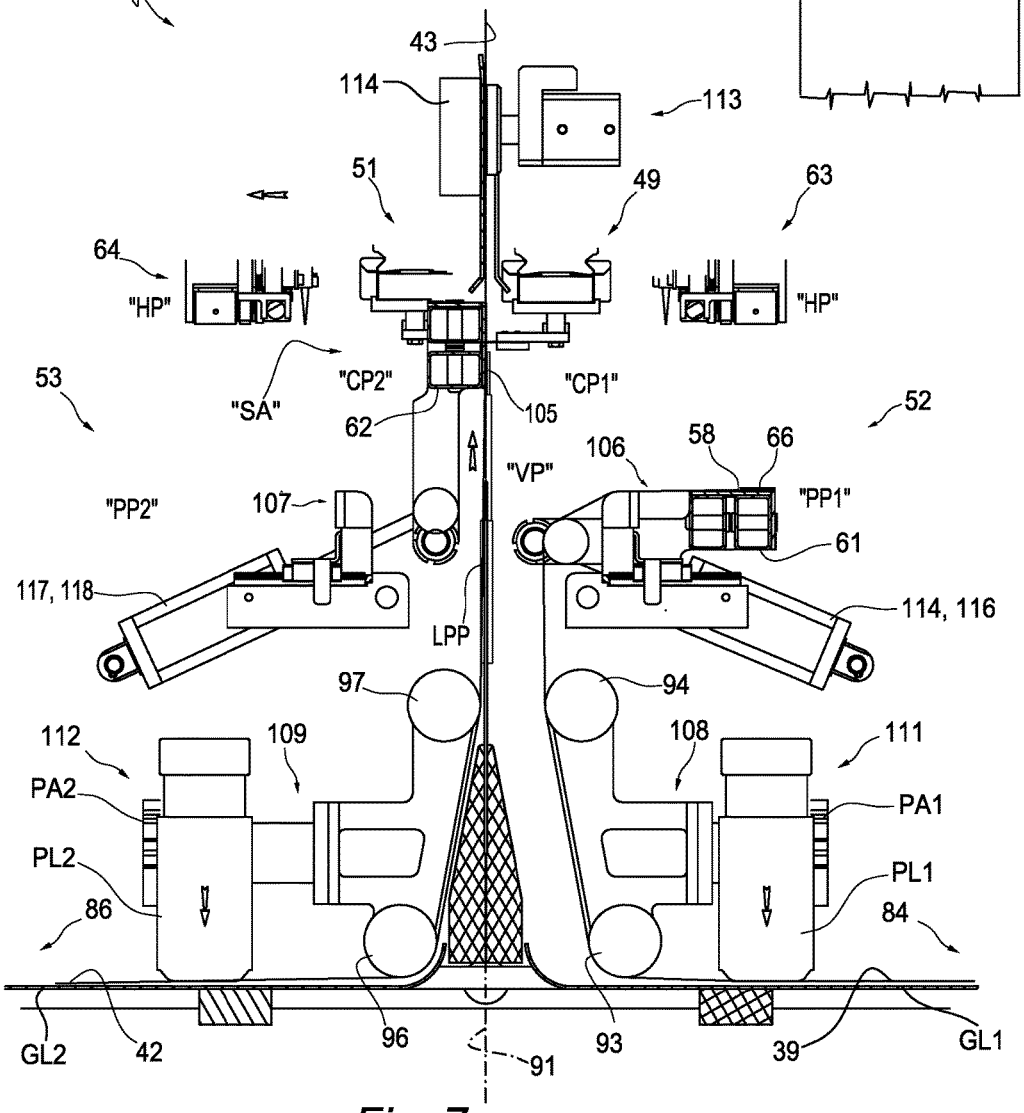

For a new request from the user apparatus 37 for the strip 39, the electronic unit 36, actuates the pneumatic pads PL1, PL2 and PL3 of the input arresting mechanisms 111 and 112 (FIG. 7) and the output arresting mechanism 113 and arrests the unwinding device 33, with lock of the strips 42 and 43 on a preset position with respect to the splicing area "SA."

Then, the solenoid valves for the pneumatic actuators RA2 are actuated, causing the rotation of the retaining member 62 on the position of contrast "CP2," with the surface 126 in contact with the strip 39. The unit 36 actuates the pneumatic rams LPP, bringing the transversal lamina 105 in front of the retaining member 62 and actuating the pneumatic cylinder CPC with shifting of the cutting elements 102 and cutting of the strip 42 (FIG. 7*a*), with definition of the terminal edge 54 and the initial edge 56.

Figure 8:
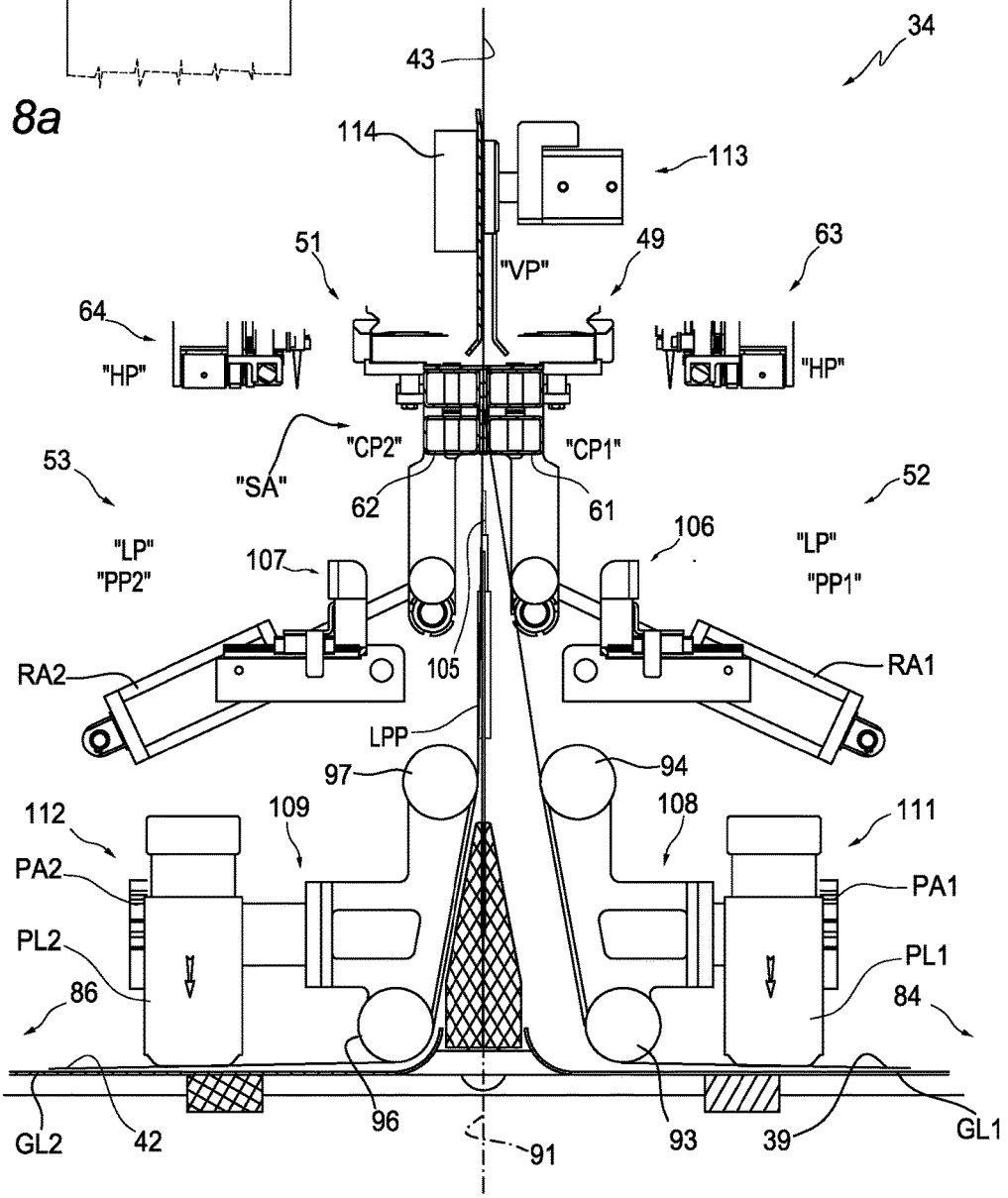

The operations proceed with the restoring of the transversal lamina 105, the retainment of the separated edges 54 and 56 in adherence with the surface 126 of the retaining member 62 and the actuation of the solenoid valves for the pneumatic actuators RA1 (FIG. 8), with rotation of the retaining member 61 on the contrast position "CP1" and pressure of the initial edge 58 of the strip 39 with the adhesive film 66 against the terminal edge 54 of the strip 42 (FIG. 8*a*). The strip 39 is spliced to the strip 42, giving rise to a section of the outgoing strip 43 constituted by the first strip 39.

The electronic unit 36 now releases the arresting mechanisms 111 and 113 and actuates the unwinding device 32 for feeding the user apparatus 37 with the first strip 39.

Naturally, the principle of the invention remaining the same, the embodiments and the details of construction can broadly be varied with respect to what has been described and illustrated, by way of non-limitative example, without by this departing from the ambit of the present invention.

We claim:

1. A splicing equipment for strips wound on a pair of spools wherein said spools are provided for supplying, in turn, an outgoing strip with a first strip and a second strip toward an user apparatus, and wherein said splicing equipment comprises a first cutting mechanism, a second cutting mechanism, a first splicing group and a second splicing group for forming the outgoing strip, by cutting and splicing, with the first strip or the second strip, said splicing equipment further comprising an output arresting mechanism actuatable for arresting the outgoing strip during operations of cutting and splicing of the first strip or the second strip; and a first applying device and a second applying device for a double sided adhesive film; wherein the first splicing group and the second splicing group include a respective retaining member provided for retaining, after cutting and separation, an initial edge of the first strip or, respectively, for retaining, after separation, an initial edge of the second strip in preparation of splicing on a terminal edge of the outgoing strip; and wherein the first applying device and the second applying device are selectively actuatable for automatically depositing the double sided adhesive film on the initial edge of the first strip or, respectively, on the initial edge of the second strip.

2. The splicing equipment according to claim 1, wherein the splicing is effected by overlapping of said initial edge of the first strip or the second strip, with respect to said terminal edge of the outgoing strip and said splicing affects a predefined overlapping distance, the first splicing group and the second splicing group comprise a respective edge shifting member and a first recovery member and a second recovery member and wherein the edge shifting member is provided for shifting an initial edge of strip retained by the respective retaining member by an amount corresponding to said overlapping distance, while the first recovery member and the second recovery member are operative, respectively, between an entering first strip and an entering second strip and the first splicing group and the second splicing group for recovering a section of strip corresponding to said overlapping distance.

3. The splicing equipment according to claim 1, wherein the outgoing strip follows an output path, which is directed upwardly and has a section to be cut and spliced tangent to a reference geometric surface substantially vertical, the first cutting mechanism and the second cutting mechanism, and the first splicing group and the second splicing group are arranged on opposite sides with respect to the reference surface, wherein said splicing equipment further comprises a first platform and a second platform of access to the first splicing group and the second splicing group, and wherein the first strip and the second strip enter underneath the first platform and, respectively, underneath the second platform.

4. The splicing equipment according to claim 1 wherein the outgoing strip has a section to be cut and spliced tangent to a splicing surface, the first cutting mechanism and second cutting mechanism include a cutting element actuatable for executing a transversal cut on the outgoing strip in a section to be cut and spliced and wherein each of the retaining member is provided for positioning between a position of contrast adjacent to the splicing surface and a position of setting-up splicing spaced away from the splicing surface;

in the position of contrast, each retaining member has function of contrast to the cutting element for the cutting of the outgoing strip, or function of contrast to the other retaining member for a pressure splicing on the outgoing strip; and in the position of setting-up splicing, each retaining member has function of retaining for an initial edge of the inactive strip and function of contrast for the automatic deposition of the adhesive film.

5. The splicing equipment according to claim 4, wherein the splicing surface is substantially vertical, while the position of setting-up splicing is substantially horizontal: the first cutting mechanism and the second cutting mechanism, and the first splicing group and the second splicing group are arranged on opposite sides with respect to the splicing surface, and wherein each of the retaining member is provided for rotation between the position of contrast and the position of setting-up splicing and wherein the position of contrast is substantially vertical and the position of setting-up splicing is substantially horizontal.

6. The splicing equipment according to the claim 5, wherein said splicing equipment further comprises a first input arresting mechanism and a second input arresting mechanism, which are arranged upstream of the first splicing group and the second splicing group for arresting, respectively, the first strip and the second strip during phases of splicing, and wherein each of the edge shifting member is adjacent to a corresponding each of the retaining member in the position of setting-up splicing, while the first recovery member and the second recovery member are arranged, respectively, between the first input arresting mechanism and the second input arresting mechanism and the corresponding each of edge shifting member.

7. The splicing equipment according to claim 6, wherein said splicing equipment further comprises a vacuum generator, while each of the retaining member and each of the edge shifting member include a respective bearing surface for an edge strip, wherein each of the bearing surface has longitudinal suction holes and is connected with the vacuum generator through a respective electrovalve, and wherein each of the electrovalve is actuatable on control of the electronic unit for retaining, by vacuum, the edge of strip inactive after the cutting as function of the shifting and, respectively, as function of the deposition of the adhesive film and the splicing.

8. The splicing equipment according to claim 4, wherein the cutting element comprises a blade with a cutting edge of double inclination for executing cuttings along opposite directions starting from rest positions adjacent to both the edges of the outgoing strip.

9. The splicing equipment according to claim 8, further comprising an electronic control unit for activating the first cutting mechanism, in the position of contrast of the retaining member of the second splicing group and wherein said electronic control unit is provided for activating the actuator of the first splicing group so as to cut the outgoing strip with a section of the second strip and to move the retaining member of the first splicing group from the position of setting-up splicing to the position of contrast for the splicing of an initial edge with adhesive of the first strip to a terminal edge of the second strip and, in sequence, for activating the actuator of the second splicing group so as to move the retaining member of the second group from the position of contrast to the position of setting-up splicing and retain, after the cutting, an initial edge, inactive, of the second strip.

10. The splicing equipment according to according to claim 1, wherein the width of the first strip is different from the width of the second strip, wherein said splicing equipment further comprises a mechanism of alignment and side margin sensors for the first strip and/or the second strip and wherein, for the first applying device and the second applying device, said electronic control unit controls said mechanism of alignment to limit the stroke of deposition of the adhesive film in response of information from said side margin sensors.

11. The splicing equipment according to claim 1 further comprising an electronic control unit for activating the first cutting mechanism or the second cutting mechanism and the first splicing group or the second splicing group so as to form the outgoing strip with sections of the first strip, alternated, on request, with sections of the second strip, without arresting of the user apparatus.

12. The splicing equipment according to claim 1, wherein said spools are unwound by a first unwinding device and a second unwinding device, said splicing equipment further comprising two introduction and transferring devices for receiving the first strip and the second strip in a condition of tiling of the first unwinding device and the second unwinding device and to transfer, respectively, the first strip and the second strip to the first cutting mechanism, the second cutting mechanism, the first splicing group and the second splicing group.

13. A method of splicing for strips with said splicing equipment according to claim 1 and including an electronic control unit, said method comprising the steps:

a) retaining, on activation of the electronic control unit, an initial edge of the first strip or, respectively, retaining an initial edge of the second strip inactive after the cutting, in preparation of a splicing on the outgoing strip; and b) actuating on control of the electronic unit the first applying device or the second applying device for applying, after the cutting, a splicing adhesive on the initial edge of the first strip or, respectively, on the initial edge of the second strip, in preparation of a splicing on the outgoing strip.

14. A splicing equipment for strips wound on a pair of spools wherein said spools unwind from a first unwinding device and a second unwinding device and are provided for supplying, in turn, an outgoing strip with a first strip and, respectively, a second strip toward an user apparatus, and wherein said splicing equipment comprises a first cutting mechanism, a second cutting mechanism, a first splicing group and a second splicing group for forming the outgoing strip, by cutting and splicing, with the first strip or the second strip, said splicing equipment further comprising two diverting devices for receiving the first strip and the second strip and transferring, respectively, the first strip and the second strip to the first cutting mechanism, the second cutting mechanism, the first splicing group and the second splicing group, a containment structure lodging the first cutting mechanism, the second cutting mechanism, the first splicing group and the second splicing group, and two platforms accessible by operators arranged at a short distance from a floor of support for the equipment between the containment structure and the first unwinding device and the second unwinding device;

wherein the first unwinding device and the second unwinding device are in a condition of tiling adjacent to an edge of said platform;

said containment structure is of substantially parallelepiped shape having two opposed lateral surfaces with a first input and, respectively, a second input for the first strip and the second strip; and wherein said diverting devices are arranged beneath said platforms and define an input port close to the edge of the platform and an output port close to another edge of the platform for providing a deviation of 90° on the path of the first strip or the second strip entering through the input port and directed to the output port.

15. The splicing equipment according to claim 14, wherein said containment structure extends upwards, with an upper body housing the first cutting mechanism, the second cutting mechanism, the first splicing group and the second splicing group, wherein the lateral surfaces with the first input and the second input are part of said upper body and wherein the first strip and the second strip are diverted upwardly from the output port of the diverting devices to said first input and said second input.

16. The splicing equipment according to claim 14, wherein said upper body defines two windows above the platforms of access to the first cutting mechanism, the second cutting mechanism, the first splicing group and the second splicing group.

17. A splicing equipment for strips wound on a pair of spools wherein said spools are provided for supplying, in turn, an outgoing strip with a first strip and a second strip toward an user apparatus, and wherein said splicing equipment comprises a first cutting mechanism, a second cutting mechanism, a first splicing group and a second splicing group for forming the outgoing strip, by cutting and splicing, with the first strip or the second strip, said splicing equipment further comprising two transferring devices for receiving the first strip and the second strip in a condition of tiling of the first unwinding device and the second unwinding device and to transfer, respectively, the first strip and the second strip to the first cutting mechanism, the second cutting mechanism, the first splicing group and the second splicing group;

wherein each of the transferring devices comprises a diverting device arranged beneath a platform accessible by operators for providing a deviation of 90° on the path of the first strip or the second strip, wherein each of the diverting device is arranged at a short distance from a floor of support for the equipment and the unwinding devices and defines an input port and an output port, the input port receives the strip coming from a respective unwinding device, while the output port is of output for the strip directed to the cutting and splicing members and further providing a diverting roller arranged substantially at 45° with respect to the input port and the output port and provided to be moved by a servo motor with respect to the input port and the output port.

* * * * *